US006374421B1

(12) United States Patent
Cleary

(10) Patent No.: US 6,374,421 B1
(45) Date of Patent: Apr. 23, 2002

(54) TROUSER SAFETY POCKET

(76) Inventor: Scott E. Cleary, 128 Jensen Rd., Vestal, NY (US) 13850

( * ) Notice: Subject to any disclaimer, the term of this patent is extended or adjusted under 35 U.S.C. 154(b) by 0 days.

(21) Appl. No.: 09/639,283

(22) Filed: Aug. 15, 2000

(51) Int. Cl.[7] ..... A41D 27/20
(52) U.S. Cl. ..... 2/254
(58) Field of Search ..... 2/254, 247, 248, 2/249, 250, 251, 252, 253

(56) References Cited

U.S. PATENT DOCUMENTS

| | | | | | |
|---|---|---|---|---|---|
| 56,821 | A | * | 7/1866 | Strecher | |
| 127,339 | A | | 5/1872 | Goodyear | |
| 198,753 | A | * | 1/1878 | Perry | |
| 1,075,240 | A | * | 10/1913 | Barrett | |
| 1,108,124 | A | * | 8/1914 | Blomenstein | |
| 1,116,643 | A | | 11/1914 | Strobel | |
| 1,122,636 | A | * | 12/1914 | Prendergast | |
| 1,226,640 | A | * | 5/1917 | Charles | |
| 1,255,497 | A | * | 2/1918 | Ankele | |
| RE15,646 | E | | 7/1923 | Wood | |
| 1,494,067 | A | * | 5/1924 | D'iorio | |
| 1,522,664 | A | * | 1/1925 | Wood | |
| 1,529,820 | A | * | 3/1925 | Wood | |
| 1,850,827 | A | * | 3/1932 | Charles | |
| 1,940,695 | A | * | 12/1933 | Petronio | 2/254 |
| 1,942,410 | A | * | 1/1934 | Charles | 2/254 |
| 2,011,010 | A | * | 8/1935 | Peters | 2/254 |
| 2,421,695 | A | * | 6/1947 | Henson | 2/254 |
| 2,557,366 | A | * | 6/1951 | Wennerstrom | 2/254 |
| 2,732,560 | A | * | 1/1956 | Frederiksen, Sr. | 2/254 |
| 2,899,684 | A | * | 8/1959 | Riley | 2/254 |
| 3,077,604 | A | * | 2/1963 | Colangelo | 2/93 |
| 5,638,549 | A | | 6/1997 | Thomas | |

* cited by examiner

*Primary Examiner*—John J. Calvert
*Assistant Examiner*—Alissa L. Hoey
(74) *Attorney, Agent, or Firm*—Salzman & Levy

(57) ABSTRACT

A safety pocket for trousers that is useful both against loss of small change and theft of paper currency therefrom. The pocket has a small, trapezoidally-shaped compartment that is sewn into a lower portion of the trouser pocket. The compartment is stitched three-fourths around, leaving a narrow opening that faces downwardly toward the lower edge of the pocket seam. Bills of large denomination can be tucked up into the compartment through the opening. Loose pocket change will roll along the pocket seam into the opening of the compartment when the trouser wearer assumes a supine or a seated position.

8 Claims, 1 Drawing Sheet

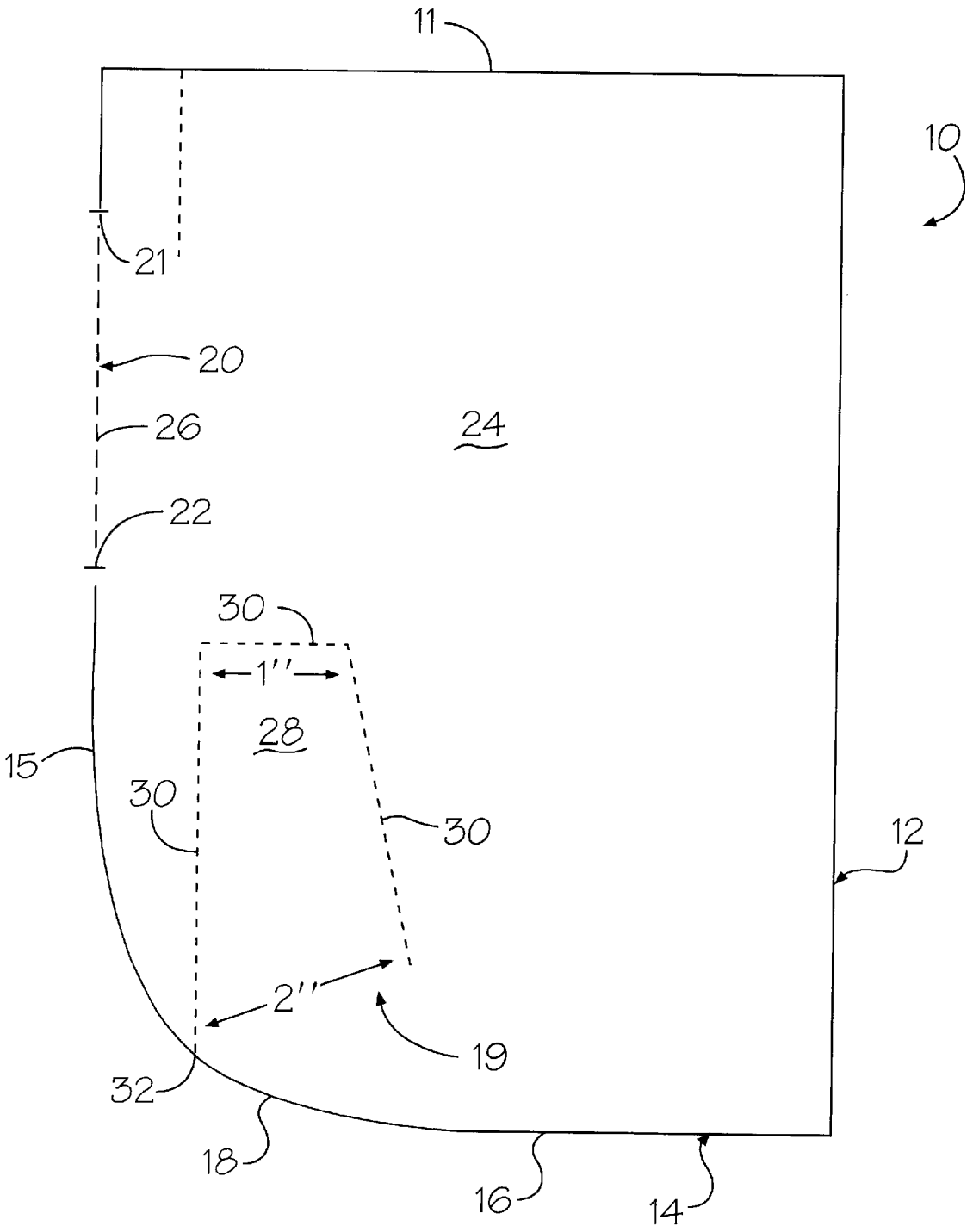
*The Figure*

TROUSER SAFETY POCKET

FIELD OF THE INVENTION

The present invention relates to pockets for trousers, and, more particularly, to an improved trouser safety pocket having an inner, sewn-in compartment that traps change from falling out of the pocket when the individual sits down, and which also provides a means for protecting paper currency from being purloined by pick pockets.

BACKGROUND OF THE INVENTION

In the art of pocket manufacturing, there have been many suggested designs for safety pockets (i.e., pockets that protect against the loss of change and other valuables, when a person sits down). One early design is illustrated in U.S. Pat. No. 1,075,240, issued to: J. Barrett on Oct. 7, 1913, entitled SAFETY POCKET FOR TROUSERS. In this design, the pocket has a flange-like extension disposed below and to the left of the pocket opening. Change and other pocket contents that come to rest in the bottom of the pocket are caused to migrate to, and become trapped in, the flange-like extension, when the person sits down or assumes a supine position. The change, or other valuables, follows the curvature of the pocket, when moving to the flange-like extension. Thus, these valuables will not fall out of the pocket when the individual is seated. The change and valuables will automatically return to the bottom of the pocket along the same pathway when the person returns to the upright position.

Although the above pocket design is very useful in trapping most change or valuables resting in the bottom of the pocket, it does nothing for protecting these items from willful extraction by pickpockets, and other nefarious individuals.

Another such safety pocket is shown in the U.S. Pat. No. Re. 15,646, reissued to C. R. Wood on Jul. 10, 1923, entitled POCKET FOR WEARING APPAREL. In this design, a broad flap extends across the pocket opening. The large flap is designed to entrap change when the wearer assumes a reclining position. The flap, however, is not designed to protect against deliberate intrusion and purloining of valuables disposed therein.

In much earlier U.S. Pat. No. 127,339, issued on May 28, 1872 to L. Goodyear for SAFETY-POCKETS, a watch pocket is shown having an internal compartment for holding change or other valuables. The watch pocket and its accompanying internal compartment is very small, and would not hold a sizable amount of change. Furthermore, the pocket is disposed in that portion of the trousers that would not suffer the loss of change when the individual was seated. The flap appears to be intended to store or hide a limited amount of valuable items that would be difficult to reach by an intruder.

In U.S. Pat. No. 1,116,643, issued to W. H. Strobel, on Nov. 10, 1914, for TROUSERS POCKET, a pocket is illustrated having a demarcation line sewn across a portion of the width of the pocket, just below the entrance thereof. The design is similar to that shown in the aforementioned patent issued to J. Barrett, because change resting in the bottom of the pocket will naturally flow to, and be trapped by, the inner portion of the pocket defined by the area disposed below the demarcation line. Such a design cannot protect against thievery.

More recently, a pocket having an inner compartment is shown in the U.S. Pat. No. 5,638,549, issued to Thomas on Jun. 17, 1997 for CHANGE-SAFE POCKET. The inner compartment is disposed within the pocket in such a manner as to catch change when the wearer sits down or leans backwards. There is no provision for protecting any pocket valuables against theft.

In summary, there are myriad designs for safety pockets that feature inner flaps, compartments, or sewn-in demarcations for trapping loose change and other valuables when the individual assumes a seated position. There are also designs, such as that illustrated in the aforementioned Goodyear patent, that are strictly for hiding or protecting valuables against robbery. However, there does not appear to be a pocket compartment flap, or demarcation, that will provide both types of safety. In other words, there does not appear to be a single design that allows the user to be safe from both loss and theft.

The present invention reflects the discovery of a trapezoidally-shaped compartment with a narrow entrance disposed in the lower half of a trouser pocket. The compartment is sewn into the lower portion of the pocket below the opening. This inner compartment provides safety against both loss and theft. The pocket compartment traps loose change from rolling out of the pocket when the individual wearer is seated, and additionally functions to hide large bills (paper currency) from the intruding hands of a pickpocket. The inner compartment has a small opening disposed in the bottom thereof for receiving change rolling along the bottom edge of the pocket. The small opening can be used to tuck bills of large denomination into the upper area of the compartment. Any hand reaching into the lower portion of the pocket would not be able to reach into, and extract the contents from, the narrow compartment entrance without extreme difficulty, and without certain detection.

SUMMARY OF THE INVENTION

In accordance with the present invention, there is provided a safety pocket that protects the trouser wearer from both loss of change and theft of large bills. A small, trapezoidally-shaped compartment having a narrow entrance is sewn into the lower half of a trouser pocket just below the pocket opening. The inner compartment has a small opening disposed in the bottom thereof for receiving change rolling along the bottom edge of the pocket when the trouser wearer assumes a supine position. The small opening can also be used to tuck bills of large denomination into the upper area of the compartment. Any hand reaching into the lower portion of the pocket would not be able to reach into, and extract the contents from, the narrow compartment entrance without extreme difficulty, and without certain detection.

It is an object of the present invention to provide an improved safety pocket for trousers.

It is another object of this invention to provide a safety pocket that is effective against both loss of small change and theft of large denomination bills.

BRIEF DESCRIPTION OF THE DRAWING

A complete understanding of the present invention may be obtained by reference to the accompanying drawing, when considered in conjunction with the subsequent detailed description, in which:

THE FIGURE illustrates an enlarged, plan view of the safety pocket of this invention.

DESCRIPTION OF THE PREFERRED EMBODIMENT

Generally speaking, the invention features a safety pocket for trousers that is useful both against loss of small change and theft of paper currency (large bills) therefrom. The pocket has a small trapezoidally-shaped compartment that is sewn into a lower portion of the trouser pocket. The compartment is stitched three-fourths around, leaving a narrow opening that faces downwardly toward the lower edge of the pocket seam. Bills of large denomination can be tucked up into the compartment through the opening. Loose pocket change will roll along the pocket seam into the opening when the trouser wearer assumes a supine position.

Now referring to THE FIGURE, the safety pocket 10 of this invention is illustrated in an enlarged, plan view. The safety pocket 10 comprises traditional pocket material, such as smooth cotton cloth or linen. The safety pocket 10 is sewn into a trouser (not shown) in normal fashion, in a way typical in the art. The edge 12 of pocket 10 depicts the inside edge. The bottom edge 14 of the pocket 10 has a straight edge portion 16 and a curved portion 18.

The opening 20 of the safety pocket 10 is represented by stitch lines 26, and is designed to receive the hand (not shown) of the trouser wearer, which is then thrust into the hollow interior 24. The stitch lines 26 of opening 20 represent both edges where the pocket 20 is respectively sewn to the trousers. It extends between respective points 21 and 22, and defines the hand size of the opening 20. The edge 15 is that portion of the pocket 10 that represents an inner edge. The top edge 11 of the pocket 10 is sewn to the belt line of the trousers.

The two sides of safety pocket 10 are sewn together along stitch lines 30 about three-fourths around, forming a trapezoidally-shaped, inner compartment 28. The upper dimension of the compartment 28 is approximately 1" (not shown to scale) in the preferred embodiment; the lower opening dimension of the compartment 28 being approximately 2" (not shown to scale) in the preferred embodiment. The stitch lines 30 of compartment 28 extend to the curved edge 18 of the bottom edge 14. Coins (not shown) that are resting on the bottom edge 14 of the pocket 10 will roll into the inner compartment 28 through the narrow opening 19, where the stitching 30 ends.

Bills of large denomination can be tucked into the opening 19, using the forefingers of the hand, and then thrust upwardly into the interior of the compartment 28. It would be extremely difficult, if not impossible, for a pickpocket to remove paper currency from compartment 28, without alerting the trouser wearer of the chicanery. Thus, the compartment 28 provides a means by which small change will not be lost, and bills of large denomination can be safeguarded against theft.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A safety pocket for trousers that is useful both against loss of small change when a wearer of said trousers assumes a supine or sitting position, and theft of paper currency, said safety pocket comprising a hollow, interior portion and means defining an opening for inserting a hand of a trouser wearer, said pocket having a small, trapezoidally-shaped compartment in said hollow, interior portion, that is sewn into a lower portion thereof, said compartment being stitched approximately three-fourths around, leaving a narrow opening facing downwardly toward a lower edge defining a bottom pocket seam for receiving change when said trouser wearer assumes a reclining position, and for preventing the purloining of bills tucked into said compartment by said trouser wearer.

2. The safety pocket in accordance with claim 1, wherein said narrow opening is approximately two inches wide.

3. A safety pocket for trousers that is useful both against loss of small change, when a wearer of said trousers assumes a sitting position, and theft of large bills, said safety pocket comprising a hollow, interior portion and means defining an opening for inserting a hand of a trouser wearer into said hollow interior portion, said pocket having a small compartment in said hollow, interior portion that is sewn into a lower portion of said safety pocket, said compartment being stitched approximately three-fourths around and forming a narrow opening facing downwardly toward a lower edge of said pocket, which lower edge defines a bottom pocket seam for supporting change, said narrow opening of said compartment receiving said change from said seam when said trouser wearer assumes a reclining position, and for preventing purloining of bills tucked into said compartment through said narrow opening by said trouser wearer.

4. The safety pocket in accordance with claim 3, wherein said narrow opening is approximately two inches wide.

5. The safety pocket in accordance with claim 3, wherein said compartment is trapezoidally-shaped.

6. A safety pocket for trousers that is useful both against loss of small change, when a wearer of said trousers assumes a sitting position, and theft of large bills, said safety pocket comprising a substantially rectangular cloth receptacle having a hollow, interior portion and means defining an opening for inserting a hand of a trouser wearer into said hollow interior portion of said receptacle, said pocket having a small compartment in said hollow, interior portion that is sewn into a lower portion of said safety pocket, said compartment being stitched approximately three-fourths around and forming a narrow opening facing downwardly toward a lower edge of said pocket, which lower edge defines a bottom pocket seam for supporting change, said narrow opening of said compartment receiving said change from said seam when said trouser wearer assumes a reclining position, and for preventing purloining of bills tucked into said compartment through said narrow opening by said trouser wearer.

7. The safety pocket in accordance with claim 6, wherein said narrow opening is approximately two inches wide.

8. The safety pocket in accordance with claim 6, wherein said compartment is trapezoidally-shaped.

* * * * *